US009578901B2

(12) United States Patent
Randall et al.

(10) Patent No.: US 9,578,901 B2
(45) Date of Patent: Feb. 28, 2017

(54) BRA WITH TWO LAYERS OF SUPPORT

(71) Applicant: Mast Industries (Far East) Limited, Kowloon (HK)

(72) Inventors: Tracey Randall, New York, NY (US); Stephanie Kristin Muhlenfeld, Old Bridge, NJ (US)

(73) Assignee: Mast Industries (Far East) Limited, Kowloon (HK)

( * ) Notice: Subject to any disclaimer, the term of this patent is extended or adjusted under 35 U.S.C. 154(b) by 341 days.

(21) Appl. No.: 14/325,992

(22) Filed: Jul. 8, 2014

(65) Prior Publication Data

US 2015/0264982 A1 Sep. 24, 2015

Related U.S. Application Data

(63) Continuation-in-part of application No. 29/485,614, filed on Mar. 20, 2014, now Pat. No. Des. 724,817, and a continuation-in-part of application No. 29/485,615, filed on Mar. 20, 2014, now Pat. No. Des. 744,718.

(51) Int. Cl.
*A41C 3/00* (2006.01)
*A41C 3/02* (2006.01)

(52) U.S. Cl.
CPC ..... *A41C 3/0057* (2013.01); *A41C 3/02* (2013.01); *A41C 3/0007* (2013.01)

(58) Field of Classification Search
CPC ..... A41C 3/02; A41C 3/08; A41C 3/0057; A41C 3/148; A41C 3/0028; A41C 3/0021; A41C 3/10; A41C 3/0064
USPC .... 450/9, 10, 15, 16, 17, 26, 28, 30–33, 58, 450/79, 36
See application file for complete search history.

(56) References Cited

U.S. PATENT DOCUMENTS

| | | | | |
|---|---|---|---|---|
| D45,287 | S | 2/1914 | Burns et al. | |
| 1,164,642 | A * | 12/1915 | Guinzburg | A41C 3/08 2/54 |
| 1,254,043 | A * | 1/1918 | James | A41C 3/08 450/31 |
| 1,811,843 | A | 6/1931 | Chilsholm | |
| 2,390,142 | A | 12/1945 | Witkower | |

(Continued)

OTHER PUBLICATIONS

Champion the Zip Sports Bra, http://www.hanes.com/champion/womens-workout/sports-bras/shop-all-bras/champion-the-zip-sports-bra-cb7920, web site visited on Dec. 15, 2014.

(Continued)

*Primary Examiner* — Gloria Hale
(74) *Attorney, Agent, or Firm* — Andrus Intellectual Property Law, LLP

(57) ABSTRACT

A front-close bra comprises a fabric back panel. A left inner bra cup and a right inner bra cup are coupled to the back panel. A left outer front panel is coupled to the left side of the back panel and is configured to cover the left inner bra cup. A right outer front panel is coupled to the right side of the back panel and is configured to cover the right inner bra cup. An inner closure couples a right side of the left inner bra cup to a left side of the right inner bra cup. An outer closure couples one of a right side of the left outer front panel and a left side of the right outer front panel to another area of the bra so as to hold the respective outer front panel in place over the respective inner bra cup that it covers.

22 Claims, 7 Drawing Sheets

(56) References Cited

U.S. PATENT DOCUMENTS

| | | | | |
|---|---|---|---|---|
| 2,609,540 | A | 9/1952 | Lo Cascio | |
| 3,254,653 | A | 6/1966 | Krieger | |
| 3,590,823 | A | 7/1971 | Pope, Jr. | |
| 3,595,243 | A * | 7/1971 | Mount | A41C 3/0007 450/5 |
| 3,930,090 | A | 12/1975 | Campbell et al. | |
| 4,325,378 | A * | 4/1982 | Wilkinson | A41C 3/02 450/58 |
| 4,538,614 | A | 9/1985 | Henderson | |
| 4,557,267 | A | 12/1985 | Cole | |
| 4,797,954 | A * | 1/1989 | Williams | A41B 1/08 2/106 |
| 4,816,005 | A | 3/1989 | Braaten | |
| 5,493,179 | A * | 2/1996 | Tanizoe | H04N 9/29 315/368.27 |
| D403,486 | S | 1/1999 | Chetwynd | |
| 5,885,910 | A | 3/1999 | Graichen | |
| 5,946,726 | A * | 9/1999 | Green | A41C 3/0057 2/102 |
| 5,968,003 | A * | 10/1999 | Sisson | A41C 3/0064 602/19 |
| 6,059,633 | A * | 5/2000 | Currier | A41C 3/08 450/10 |
| 6,165,045 | A | 12/2000 | Miller et al. | |
| 6,168,498 | B1 | 1/2001 | Wagner | |
| 6,186,861 | B1 | 2/2001 | Flaherty | |
| 6,186,862 | B1 * | 2/2001 | Fildan | A41C 3/122 450/41 |
| D438,691 | S | 3/2001 | Zagame | |
| 6,332,825 | B1 | 12/2001 | Henricksen | |
| 6,446,268 | B1 | 9/2002 | Lazarian | |
| 7,090,558 | B2 | 8/2006 | Ott | |
| 7,186,163 | B2 * | 3/2007 | Carlucci | A41C 3/148 450/28 |
| 7,228,809 | B2 | 6/2007 | Angelino et al. | |
| 7,422,508 | B2 | 9/2008 | Bentham | |
| 7,435,155 | B2 | 10/2008 | Reinisch et al. | |
| 7,588,479 | B2 | 9/2009 | Falla | |
| 7,628,675 | B2 * | 12/2009 | Staub | A41C 3/0057 2/102 |
| D635,329 | S | 4/2011 | Wahl et al. | |
| 7,922,682 | B2 | 4/2011 | Bell et al. | |
| D641,133 | S | 7/2011 | Zarabi | |
| 8,403,724 | B1 * | 3/2013 | Chapin | A41C 3/08 2/106 |
| 8,439,721 | B2 | 5/2013 | Sokolowski et al. | |
| 8,523,629 | B2 | 9/2013 | Pundyk | |
| D690,905 | S | 10/2013 | Eutsey et al. | |
| 8,545,287 | B2 * | 10/2013 | Campbell | A41C 3/0021 450/30 |
| 8,690,634 | B2 | 4/2014 | Heath et al. | |
| 8,758,081 | B2 * | 6/2014 | Yuasa | A41C 3/0028 450/31 |
| 8,832,862 | B1 | 9/2014 | Solis | |
| 8,858,295 | B2 * | 10/2014 | Thompson | A41F 15/002 450/10 |
| 9,192,197 | B2 * | 11/2015 | Reinhard | A41C 3/0064 |
| 2004/0168479 | A1 * | 9/2004 | McMurray | D02G 3/326 66/202 |
| 2005/0112996 | A1 * | 5/2005 | Buehler | A41F 1/006 450/58 |
| 2005/0266770 | A1 | 12/2005 | Henricksen | |
| 2007/0004314 | A1 * | 1/2007 | Carlucci | A41C 3/148 450/30 |
| 2008/0153388 | A1 | 6/2008 | Liu | |
| 2008/0261490 | A1 | 10/2008 | Scheininger | |
| 2008/0261491 | A1 | 10/2008 | Scheininger | |
| 2009/0047481 | A1 | 2/2009 | Welsch et al. | |
| 2010/0144242 | A1 | 6/2010 | Allen et al. | |
| 2010/0183814 | A1 | 7/2010 | Rios | |
| 2010/0297911 | A1 | 11/2010 | Liu | |
| 2011/0067162 | A1 | 3/2011 | Solis | |
| 2011/0104985 | A1 | 5/2011 | Linder et al. | |
| 2011/0312245 | A1 | 12/2011 | Allen | |
| 2012/0021669 | A1 * | 1/2012 | Johnstone | A41C 3/0028 450/58 |
| 2012/0045967 | A1 * | 2/2012 | Punsal | A41C 3/0057 450/82 |
| 2012/0276811 | A1 * | 11/2012 | Nakajima | A41C 3/10 450/31 |
| 2013/0316616 | A1 * | 11/2013 | Thompson | A41F 15/002 450/66 |
| 2014/0087625 | A1 | 3/2014 | Ironi | |

OTHER PUBLICATIONS

Playtex Play Zip Zip Hurray Front-Close Wirefree Bra, http://www.championusa.com/workout-clothes/women/sports-bras/everyday-bras-85068--1/playtex-play-zip-zip-hurray-wirefree-bra-25658?cm_vc=OnsiteSearch&csSearchTerm=playtex play zip zip, web site first visited on May 9, 2014 and Dec. 15, 2014.

CW-X XTEMPO Running Bra, http://cw-x.com/ExploreProducts.aspx?product=bras&by=collection&gender=womens, web site visited on May 9, 2014 and Dec. 15, 2014.

Fruit of the Loom Comfort Front-Close Sports Bra, http://www.walmart.com/ip/Fruit-of-the-Loom-Comfort-Front-Close-Racerback-Sport-Bra-2-pack-FT390/33102925, web site visited on May 20, 2014.

Nike Women's Pro Zip Front Bra, http://www.tennisexpress.com/NIKE-Womens-Pro-Bra-Zip-Front-32275?utm_source=google&utm_medium=cse&utm_term=&k=&gclid=CMSQ8qiQu74CFXQiMgodhCsAQQ, web site visited on May 20, 2014.

Spanx Top-Notch Sports Bra, http://www.spanx.com/shop/spanx/active/style/sports-bras/top-notch-sports-bra-zid38-1942/cat-38-catid-fncat_spx_act_styl_br-sprt, web site visited on May 20, 2014.

Valmont Zip Front Sports Bra, http://www.justmysize.com/plus-size/workout/workout-styles/sports-bras/valmont-zip-front-sports-bra, web site visited on May 20, 2014 and Dec. 15, 2014.

Notice of Allowance in corresponding Design U.S. Appl. No. 29/485,614, mailed on Jan. 16, 2015.

Ex Parte Quayle in corresponding Design U.S. Appl. No. 29/485,615, mailed on Mar. 12, 2015.

Anita Active Front Close Sports Bra, http://www.herroom.com/anita-5523-active-front-close-sports-bra.shtml, web site visited on May 9, 2014.

Body Central Zip Front Sports Bra, http://www.bodycentral.com/products/zip-front-sports-bra/, web site visited on May 9, 2014.

Champion Zip Tech Sports Bra, http://www.championusa.com/workout-clothes/women/sports-bras/bestselling-bras-85063--1/champion-zip-tech-sports-bra, web site visited on May 9, 2014.

Playtex Play Zip Zip Hurray Wirefree Bra #4886, http://www.championusa.com/workout-clothes/women/sports-bras/everyday-bras-85068--1/playtex-play-zip-zip-hurray-wirefree-bra-25658?cm_vc=OnsiteSearch&csSearchTerm=playtex play zip zip, web site visited on May 9, 2014.

CW-X Conditioning Wear, http://cw-x.com/ExploreProducts.aspx?product=bras&by=collection&gender=womens, web site visited on May 9, 2014.

Danskin Now Front Close Deep Plunge Sport Bra, http://www.walmart.com/ip/Danskin-Now-Front-Close-Deep-Plunge-Sport-Bra/17480246, web site visited on May 20, 2014.

Fruit of the Loom Comfort Front-Close Sports Bra, http://www.walmart.com/ip/Fruit-of-the-Loom-Comfort-Front-Close-Sports-Bra-Style-96014/13997192, web site visited on May 20, 2014.

Enell Sports Bra 100, http://www.herroom.com/enell-100-sports-bra.shtml, web site visited on May 20, 2014.

Enell Lite Sports Bra NL101, http://www.herroom.com/Enell-NL101-Lite-Sports-Bra.shtml?utm_source=adv&utm_medium=search&device=c&network=g&matchtype=&utm_campaign=pla, web site visited on May 20, 2014.

Fruit of the Loom, Front Close Racerback Sport Bra, http://www.walmart.com/ip/Fruit-of-the-Loom-Front-Close-Racerback-Sport-Bra-2-pack-FT390/33102925, web site visited on May 20, 2014.

(56) References Cited

OTHER PUBLICATIONS

Lift & Separate IV, http://shop.lululemon.com/products/clothes-accessories/bras-medium-support/Lift-And-Separate-IV?cc=7501&skuId=3533091&catId=bras-medium-support, web site visited on May 20, 2014.
Nike Women's Pro Zip-Front Sports Bra, http://www.tennisexpress.com/NIKE-Womens-Pro-Bra-Zip-Front-32275?utm_source=google&utm_medium=cse&utm_term=&k=&gclid=CMSQ8qiQu74CFXQiMgodhCsAQQ, web site visited on May 20, 2014.
Playtex Women's Play Zip Zip Horray Wirefree Racerback Bra, http://www.amazon.com/Playtex-Womens-Hooray-Wirefree-Racerback/dp/B00FXT66ME, web site visited on May 20, 2014.
Shock Absorber Active Zipped Plunge, http://shockabsorber.co.uk/en/products/active-range/active-zipped-plunge/, web site visited on May 20, 2014.
Top Notch Sports Bra, http://www.spanx.com/shop/spanx/active/style/sports-bras/top-notch-sports-bra-zid38-1942/cat-38-catid-fncat_spx_act_styl_br-sprt, web site visited on May 20, 2014.
Armour Bra Protegee D Cup, http://www.underarmour.com/shop/us/en/armour-bra-protege-d-cup/pid1236592, web site visited on May 20, 2014.
Valmont Zip Front Sports Bra, http://www.justmysize.com/plus-size/workout/workout-styles/sports-bras/valmont-zip-front-sports-bra, web site visited on May 20, 2014.

* cited by examiner

BRA WITH TWO LAYERS OF SUPPORT

CROSS-REFERENCE TO RELATED APPLICATIONS

This application a continuation-in-part of U.S. Design patent application No. 29/485,614 and a continuation-in-part of U.S. Design patent application No. 29/485,615, both filed Mar. 20, 2014, and both of which are hereby incorporated by reference in their entireties.

FIELD

The present disclosure relates to a bra for supporting a wearer's breasts. More specifically, the present disclosure relates to a bra that provides advantageous benefits to a wearer while it is being put on and while it is worn during exercise.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example of the present disclosure, a front-close bra comprises a fabric back panel having a left side, a right side, a top side, and a bottom side. A left inner bra cup has a left side coupled to the left side of the back panel and a right inner bra cup has a right side coupled to the right side of the back panel. A left outer front panel has a left side coupled to the left side of the back panel and configured to cover the left inner bra cup, and a right outer front panel has a right side coupled to the right side of the back panel and configured to cover the right inner bra cup. An inner closure couples a right side of the left inner bra cup to a left side of the right inner bra cup and an outer closure couples one of a right side of the left outer front panel and a left side of the right outer front panel to another area of the bra so as to hold the respective outer front panel in place over the respective inner bra cup that it covers.

According to another example of the present disclosure, a front-close bra comprises a fabric back panel having a left side, a right side, a top side, and a bottom side. A left convex inner bra cup has a lower edge with a first underwire and has a left side coupled to the left side of the back panel. A right convex inner bra cup has a lower edge with a second underwire and has a right side coupled to the right side of the back panel. A left outer front panel has a left side coupled to the left side of the back panel and is capable of covering the left inner bra cup, and a right outer front panel has a right side coupled to the right side of the back panel and is capable of covering the right inner bra cup. An inner closure couples a right side of the left inner bra cup to a left side of the right inner bra cup, and an outer closure couples a right side of the left outer panel to a left side of the right outer panel. The bra further includes left and right back straps extending from the top side of the back panel and left and right outer shoulder straps coupling the left and right back straps to a top portion of the left outer front panel and a top portion of the right outer front panel, respectively. The bra further includes left and right inner shoulder straps having first ends coupled to first and second interior faces of the left and right outer shoulder straps, respectively, and second ends coupled to a top portion of the left inner bra cup and a top portion of the right inner bra cup, respectively. The left and right inner bra cups encapsulate, lift, and separate a wearer's breasts and the left and right outer panels compress the wearer's breasts so as to minimize movement thereof.

BRIEF DESCRIPTION OF DRAWINGS

The present disclosure is described with reference to the following Figures. The same numbers are used throughout the Figures to reference like features and like components.

DETAILED DESCRIPTION

Figure 1:
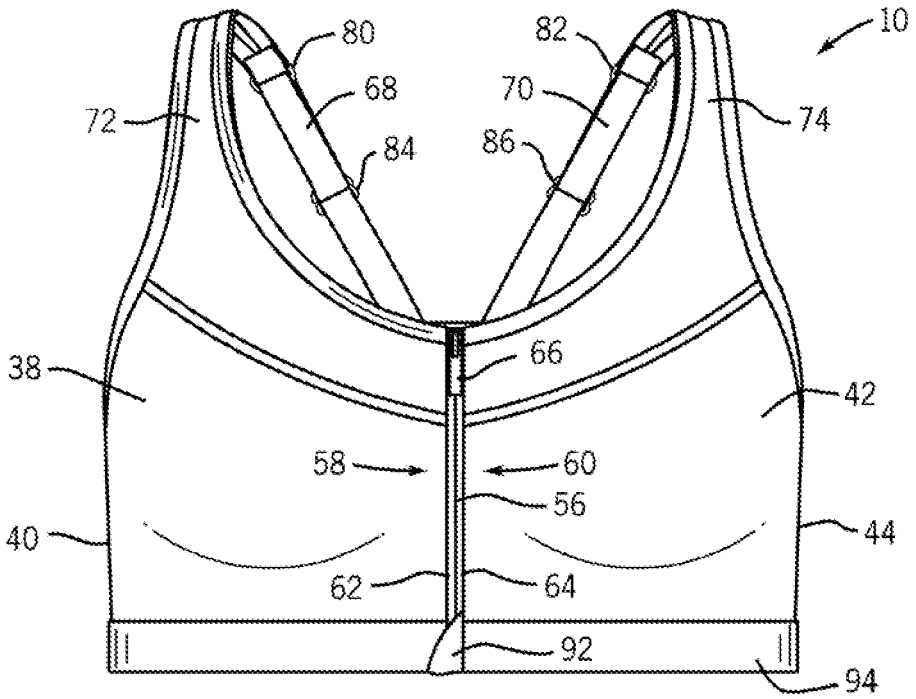
FIG. 1 is a front view of a front-close bra according to the present disclosure.
Figure 2:
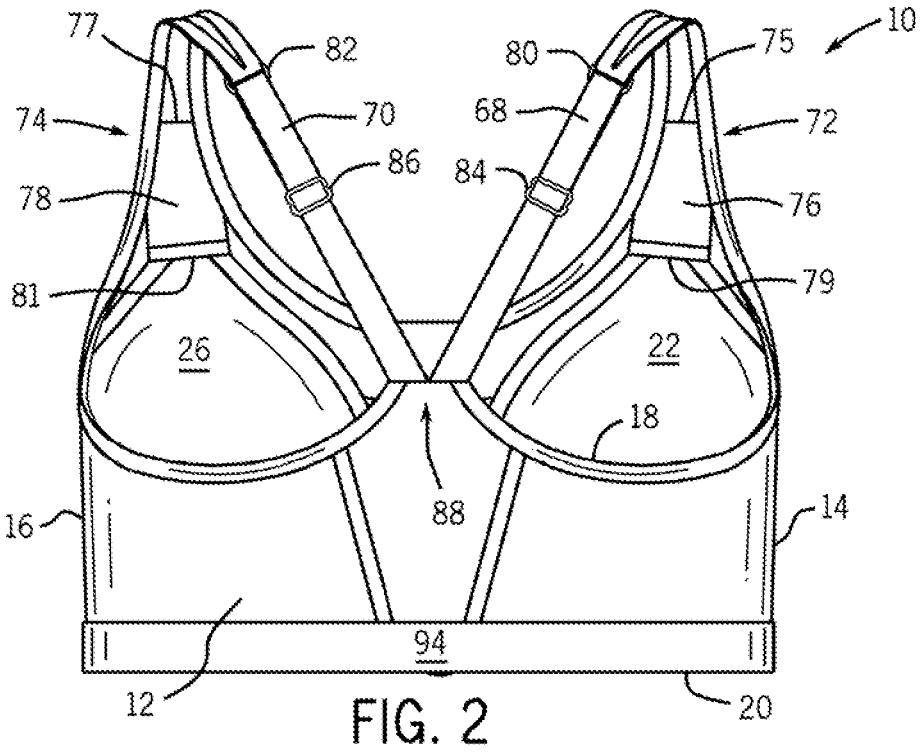
FIG. 2 is a rear view of the front-close bra.
Figure 3:
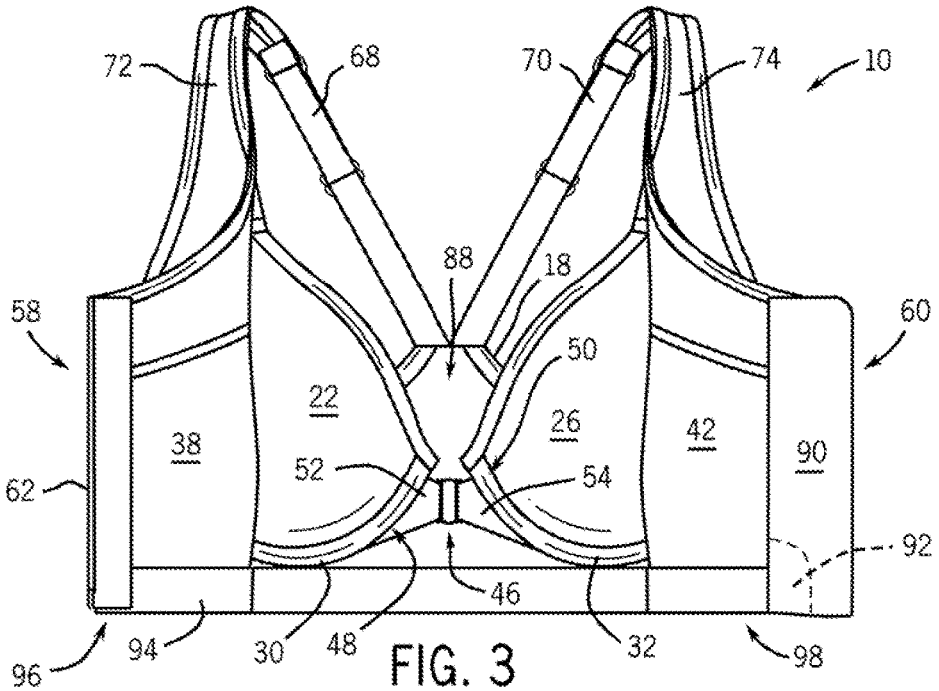
FIG. 3 is a front view of the front-close bra, showing the bra in an alternative position.
Figure 4:
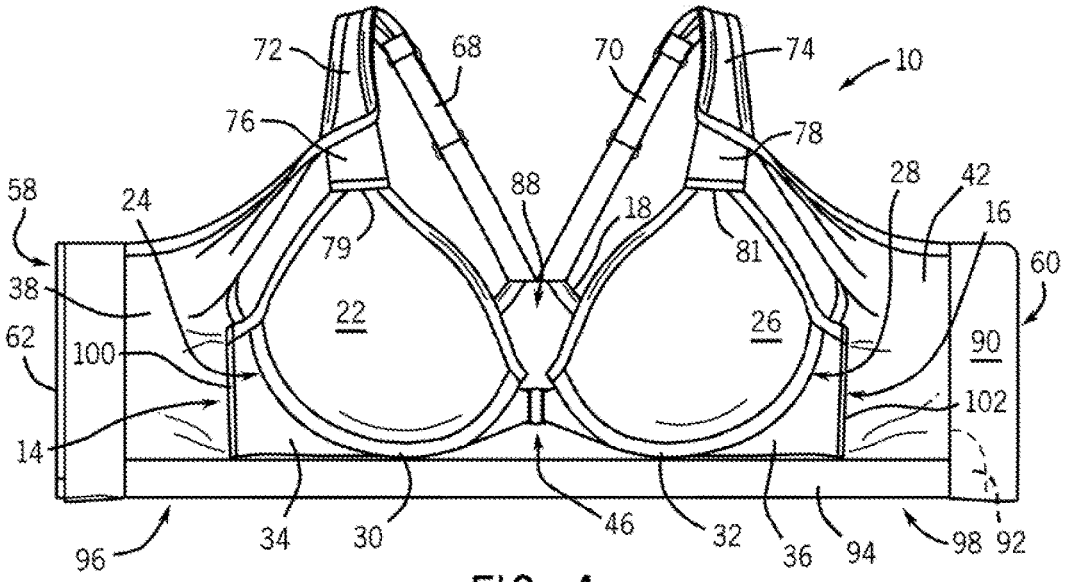
FIG. 4 is a front view of the front-close bra, showing the bra in another alternative position.

FIGS. 1-5 and 7-8 illustrate a front-close bra 10 according to the present disclosure. With reference specifically to FIG. 2, the bra comprises a fabric back panel 12 having a left side 14, a right side 16, a top side 18, and a bottom side 20. Each of these sides are described as if the bra 10 was viewed from the front (i.e., from the perspective of FIG. 1), so for example the left side 14 appears on the right in FIG. 2. With particular reference to FIGS. 3 and 4, the bra 10 further includes a left inner bra cup 22 having a left side 24 coupled to the left side 14 of the back panel 12, and a right inner bra cup 26 having a right side 28 coupled to the right side 16 of the back panel 12. As shown, the left and right inner bra cups 22, 26 have somewhat rounded lower edges 30, 32, respectively. A left outer area of rounded lower edge 30 is attached to a left side stay 34, which is in turn attached to the left side 14 of the back panel 12, such as for example by sewing along a left side seam 100. A right outer area of rounded lower edge 32 is attached to a right side stay 36, which is in turn attached to the right side 16 of the back panel 12, such as for example by sewing along right side seam 102. In another example, the inner bra cups 22, 26 are extended outwardly such that they are attached directly to the back panel 12 at their respective left and right sides 24, 28 at side seams 100, 102, without the need for left and right side stays 34, 36. The attachments mentioned above can be made by gluing, sewing, integral knitting, ultrasonic welding, ultrasonic sewing etc. In the example shown, each of the rounded lower edges 30, 32 comprises an underwire, which is inserted in the left and right inner bra cups 22, 26 in a manner known to those having ordinary skill in the art.

With reference to FIGS. 1 and 3, the bra 10 further comprises a left outer front panel 38 having a left side 40 coupled to the left side 14 of the back panel 12, and a right outer front panel 42 having a right side 44 coupled to the right side 16 of the back panel 12. The left outer front panel 38 is configured to cover the left inner bra cup 22 and the right outer front panel 42 is configured to cover the right inner bra cup 26, as can be seen by comparison of FIG. 1 with FIG. 3. In one example, the outer front panels 38, 42 are made of a spandex blend, and may include a mesh fabric structure.

Figure 5:
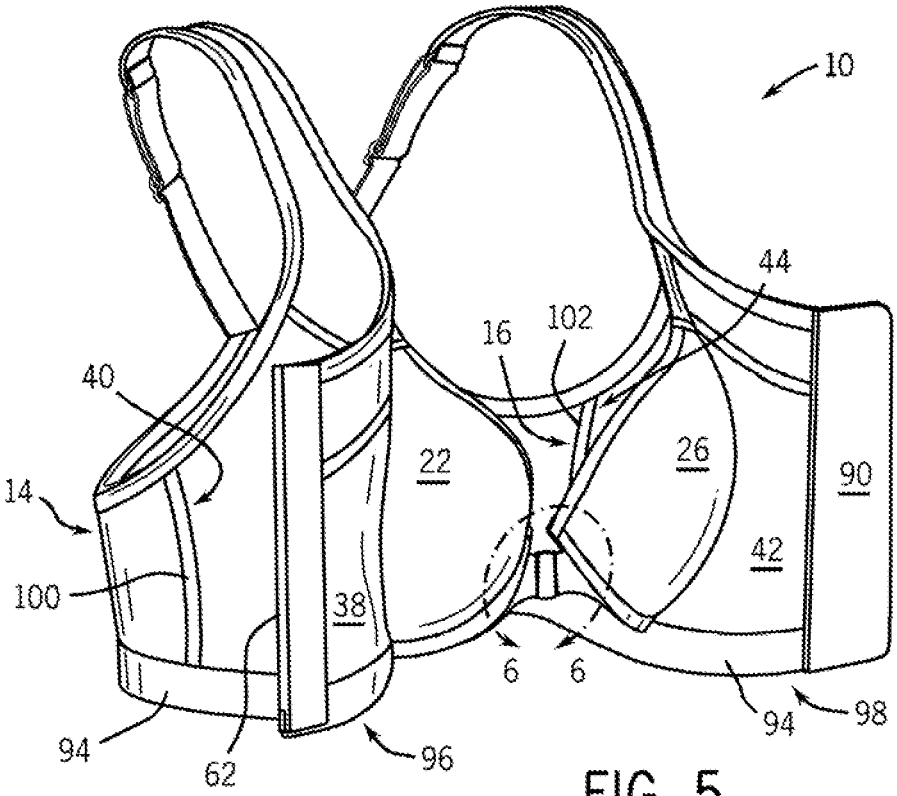
FIG. 5 is a front perspective or three-quarter view of the front-close bra according to the present disclosure.
Figure 6:
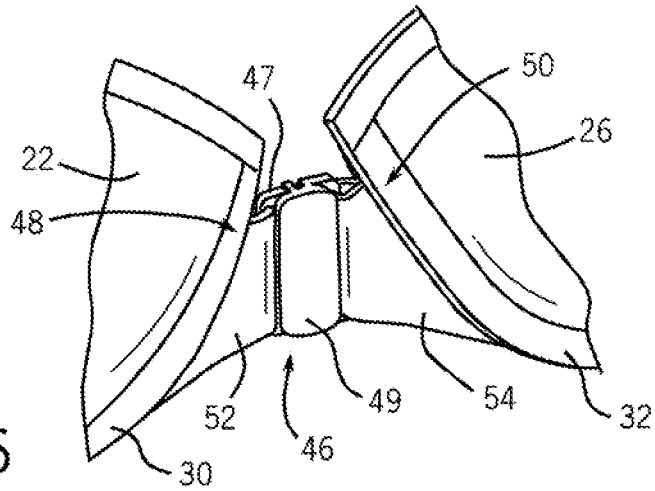
FIG. 6 is a detailed view of the area encompassed by the dashed lines labeled 6-6 in FIG. 5.
Figure 7:
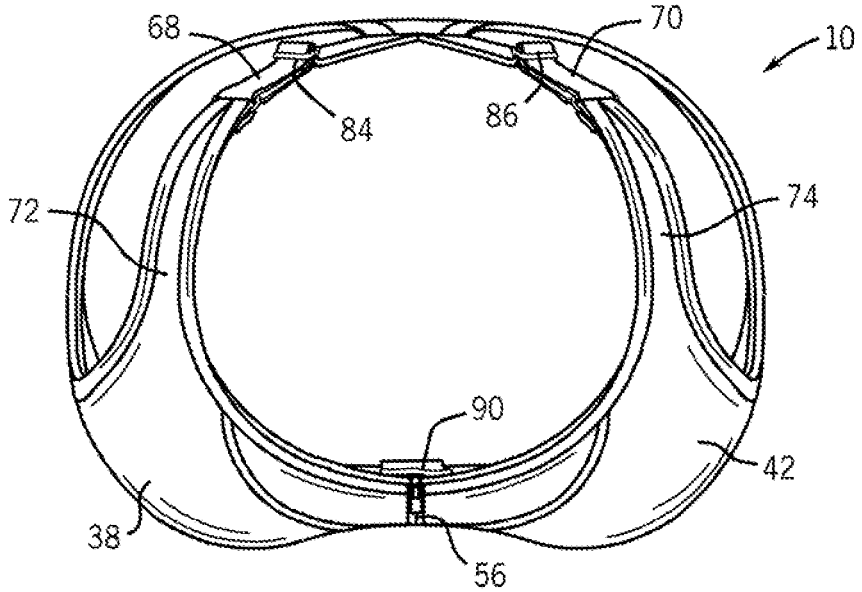
FIG. 7 is a top view of the front-close bra according to the present disclosure.

As shown in FIGS. 3, 5, and 6, the bra 10 further comprises an inner closure 46 that couples a right side 48 of the left inner bra cup 22 to a left side 50 of the right inner bra cup 26. As shown herein, the right side 48 of the left inner bra cup 22 is attached to a piece of fabric 52, which is in turn attached to the inner closure 46, and the left side 50 of the right inner bra cup 26 is attached to a similar piece of fabric 54, which is in turn attached to the inner closure 46. The inner closure 46 is coupled to the pieces of fabric 52, 54 at ends that are opposite where the pieces of fabric 52, 54 are attached to the inner bra cups 22, 26. In another example, the bra cups 22, 26 are directly connected to the inner closure 46 without the need for the pieces of fabric 52, 54. The above-mentioned attachments can be made by gluing, sewing, integral knitting, ultrasonic welding, ultrasonic sewing, etc.

In the example shown, the inner closure 46 is a clasp having a left clasp half 47 and a mating right clasp half 49. The left clasp half 47 is coupled to the right side 48 of the left inner bra cup 22 and the right clasp half 49 is coupled to the left side 50 of the right inner bra cup 26. Again, with reference to FIGS. 3 and 6, in the example shown, such coupling is accomplished via pieces of fabric 52, 54, respectively. In the example shown, the clasp halves 47, 49 can be easily clicked together to close the front of the inner bra. In other examples, the inner closure 46 comprises a hook and eye closure, Velcro, snaps, magnets, buttons, ties of any sort, toggles, or poppers.

With reference hack to FIG. 1, the bra 10 further comprises an outer closure that couples one of a right side 58 of the left outer front panel 38 and a left side 60 of the right outer front panel 42 to another area of the bra 10 so as to hold the respective outer front panel 38, 42 in place over the respective inner bra cup 22, 26 that it covers. It should be noted that the right and left sides 58, 60 of the outer front panels 38, 42 are referred to as such as if they were in a closed position (i.e., covering the inner bra cups 22, 26 as in FIG. 1). Thus, In FIGS. 3 and 4, these sides 58, 60 appear to be mislabeled, but in fact are not.

In the example shown, the outer closure 56 couples a right side 58 of the left outer front panel 38 to a left side 60 of the right outer front panel 42. Further, in the example shown, the outer closure 56 is a zipper having a left zipper half 62 and a mating right zipper half 64. As known to those having ordinary skill in the art, the left zipper half 62 and the right zipper half 64 can be combined by pulling a zipper pull 66 so as to join together mating teeth on each of the left and right zipper halves 62, 64. In the example shown, the left zipper half 62 is coupled to the right side 58 of the left outer front panel 38 and the right zipper half 64 is coupled to the left side 60 of the right outer front panel 42.

Figure 11A:
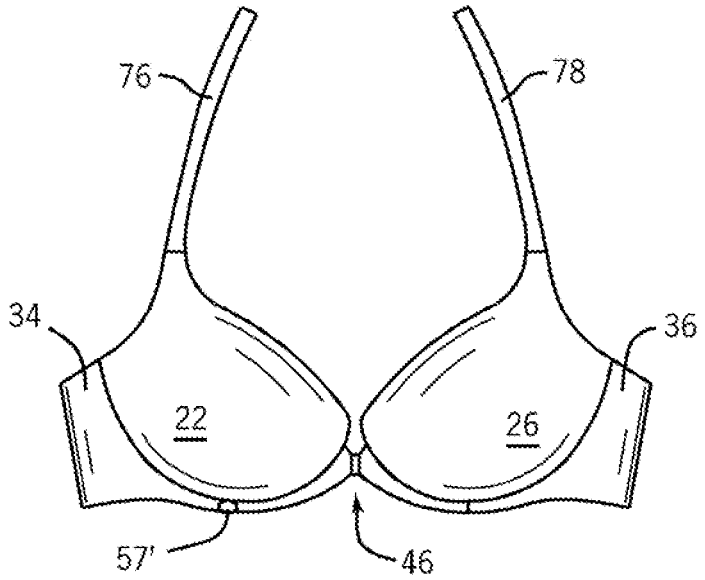
FIGS. 11A and 11B illustrate another alternative example of a front-close bra according to the present disclosure.
Figure 11B:
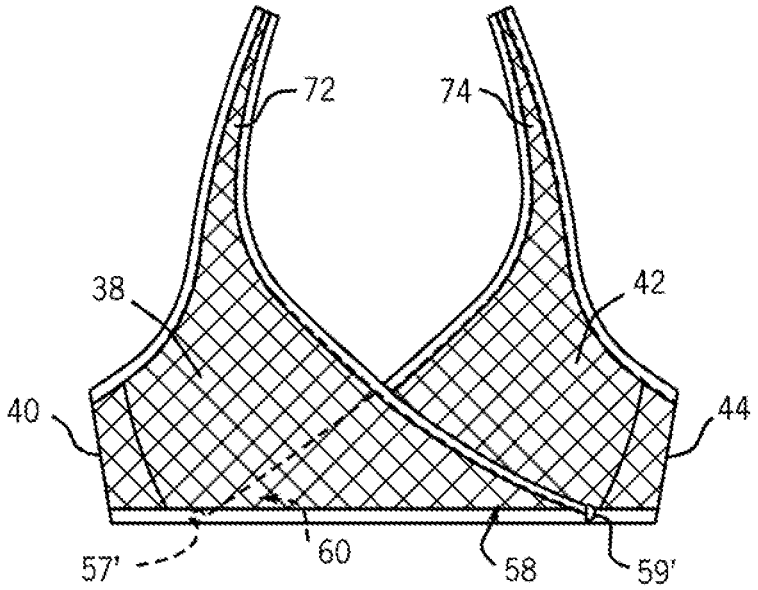

In other examples, such as shown in FIGS. 10A, 10B, 11A, and 11B, the outer front panels 38, 42 may have a more of a triangular shape and may be folded across one another to create a cross-over front to the bra 10. In the example shown in FIGS. 10A and 10B, the left side 60 of the right outer front panel 42 may be coupled by a closure 57 to the left side stay 34 at a bottom edge thereof. The closure 57 therefore would have one half connected to the left side 60 of the right outer front panel 42 and one half connected to the left side stay 34. The right side 58 of the left outer front panel 38 may then be crossed over the right outer front panel 42 and coupled by a closure 59 to an area near the right side 44 of the right outer front panel 42. The closure 59 would therefore have one half connected to the right side 58 of the left outer front panel 38 and one half connected to the right side 44 of the right outer front panel 42. In the examples of FIGS. 11A and 11B, the location of connection of the outer front panels 38, 42 to the remainder of the bra 10 is moved inwardly, such that closure 57' is provided directly beneath left inner bra cup 22, and closure 59' is provided more inwardly of right side 44 of right outer front panel 42, and closer to being located directly underneath right inner bra cup 26, yet connected to right outer front panel 42. It should be understood that in both examples shown in FIGS. 10A-10B and 11A-11B, which outer front panel 38, 42 is crossed over the other could be reversed. In this way, one of the closures 57, 57' or 59, 59' constitutes an outer closure that couples one of a right side 58 of the left outer front panel 38 and a left side 60 of the right outer front panel 42 to another area of the bra 10 so as to hold the respective outer front panel 38, 42 in place over the respective inner bra cup 22, 26 that it covers.

In each of the above-described examples, the closure 56, 57, 59 may be a zipper, a hook and eye closure, a Velcro closure, a series of magnets, a magnetic zipper, gecko tape, a magnetic hook and eye closure, buttons, ties of any sort, toggles, two or more clips/clasps, or a series of poppers.

With reference to FIGS. 1-4 and 8, the bra 10 further comprises left and right back straps 68, 70 (or fabric spacer straps) extending from the top side 18 of the back panel 12. In one example, the bra 10 further comprises left and right outer shoulder straps 72, 74 that couple the left and right back straps 68, 70 to a top portion of the left outer front panel 38 and a top portion of the right outer front panel 42, respectively. In one example, the outer shoulder straps 72, 74 are padded. The bra 10 further comprises left and right inner shoulder straps 76, 78 coupling, the left and right back straps 68, 70 to a top portion of the left inner bra cup 22 and a top portion of the right inner bra cup 26, respectively. As shown in FIG. 2, the left and right inner shoulder straps 76, 78 are coupled to first and second interior faces of the left and right outer shoulder straps 72, 74, respectively. More specifically, the left and right inner shoulder straps 76, 78 have first ends 75, 77 coupled to first and second interior faces of the left and right outer shoulder straps 72, 74, respectively, and second ends 79, 81 coupled to a top portion of the left inner bra cup 22 and a top portion of the right inner bra cup 26, respectively.

Figure 8:
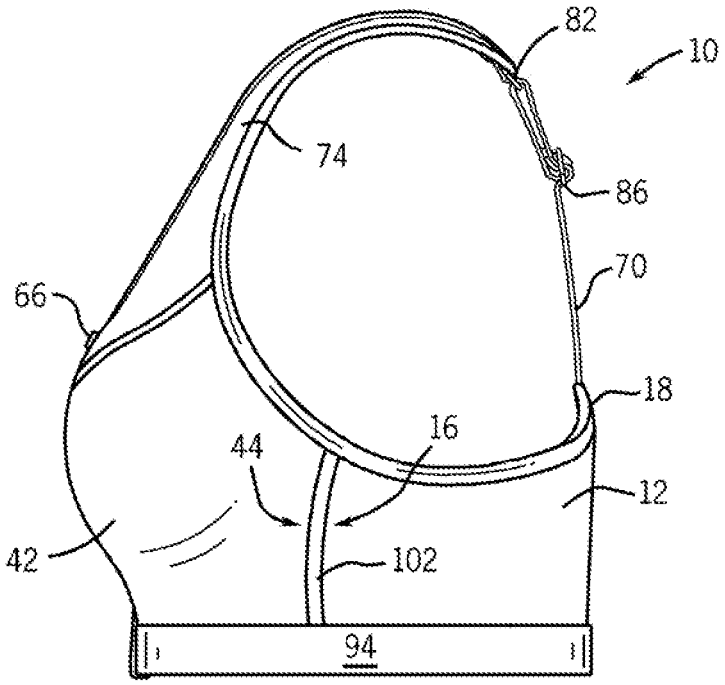
FIG. 8 is a side view of the front-close bra according to the present disclosure.

In addition, as also shown in FIGS. 2 and 8, the left and right outer shoulder straps 72, 74 are coupled to the left and right back straps 68, 70, respectively, by first and second rings 80, 82. The rings 80, 82, in combination with first and second strap adjuster slides 84, 86, allow for adjustment of a length of the left and right back straps 68, 70.

As shown in FIGS. 2-4, the left and right back straps 68, 70 are coupled to the top side 18 of the back panel 12 proximate a center area 88 of the back panel 12 so as to form a racer-back shape. This racer-back shape can take the form of a Y or a V. In alternative examples, the left and right back straps 68, 70 are coupled to the top side 18 of the back panel 12 closer to outer edges of the back panel 12 than the coupling shown herein, and therefore form more of a U-shape with the back panel 12. In another example, the back straps 68, 70 cross one another to form an X. In another example, the back straps 68, 70 can extend parallel to one another (i.e., connect to the back panel 12 at outer edges therefor) and may be optionally held together with a clip adjuster.

With reference to FIGS. 3-5 and 7, several features of the bra 10 provide comfort and protection from contact with the outer closure 56 while the bra 10 is worn. In one example, the bra 10 further comprises a fabric strip 90 extending along one of the right side 58 of the left outer front panel 38 and the left side 60 of the right outer front panel 42. The fabric strip 90 is located behind one of the left and right zipper halves 62, 64 (see FIG. 7), respectively, so as prevent contact of the zipper with a wearer's body. In other words, the fabric strip 90 is located between the zipper (or other outer closure 56) and the wearer's body. In the example shown, the fabric strip 90 is located along the left side 60 of the right outer front panel 42 and behind the right zipper half 64. The right zipper half 64 is therefore not visible in FIGS. 3, 4, and 5 as it is situated on the opposite side of the fabric strip 90 from that shown. When the left zipper half 62 is joined to the right zipper half 64, it also is situated in front of the fabric strip 90 so that the zipper does not contact the wearer's body, and is visible from the front of the bra 10 (see FIG. 1).

The bra 10 may further comprise a fabric pocket 92 coupled to a lower portion of one of the right side 58 of the left outer front panel 38 and the left side 60 of the right outer front panel 42. The fabric pocket 92 envelops a lower end of the zipper and prevents the lower end of the zipper from contacting the wearer's body. In the example shown, the fabric pocket 92 is coupled to a lower portion of the left side 60 of the right outer front panel 42, and in front of the fabric strip 90. The approximate location of the fabric pocket 92 is shown in FIGS. 3 and 4 by a dashed line, although it should be understood that the fabric pocket 92 is actually provided on the reverse side of the fabric strip 90 from that shown in FIGS. 3 and 4.

The bra 10 further comprises an elastic band 94 that extends along a bottom side 96 of the left outer front panel 38, along the bottom side 20 of the back panel 12, and along a bottom side 98 of the right outer front panel 42. The elastic band 94 fits snuggly against a wearer's torso around her rib cage. In another example, the side stays 34, 36 of the inner bra cups 22, 26 are connected at their other edges by a separate, second piece of elastic (and perhaps fabric, as well) that extends around the wearer's back, effectively creating a back panel for the inner bra, which is separated from the back panel 12 of the outer bra at the bottom side 20 thereof.

With reference to FIGS. 4 and 5, in one example, the left side 24 of the left inner bra cup 22 and the left side 40 of the left outer front panel 38 are coupled to the left side 14 of the back panel 12 at a left side seam 100. The right side 28 of the right inner bra cup 26 and the right side 44 of the right outer front panel 42 are coupled to the right side 16 of the back panel 12 at a right side seam 102. In another example, the back panel 12 and the left and right outer front panels 38, 42 are integral with one another (i.e., made of one piece of fabric) and the inner bra cups 22, 26 are coupled thereto. In another example, the back panel 12 and the left and right inner bra cups 22, 26 are integral with one another and the outer front panels 38, 42 are coupled thereto.

Figure 9:
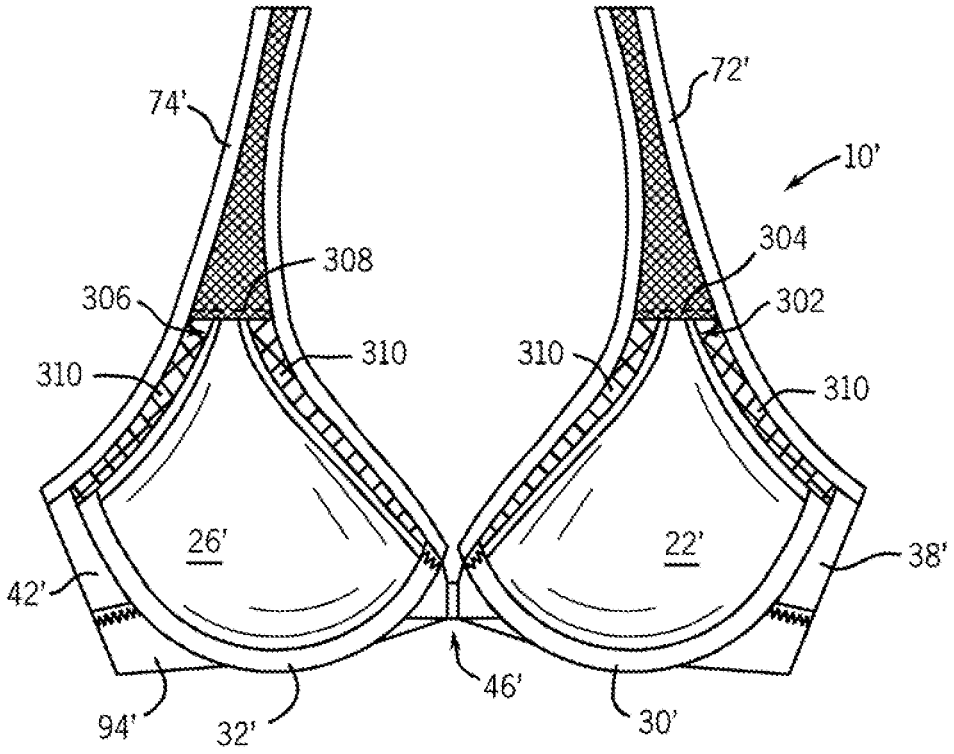
FIG. 9 illustrates another example of a front-close bra according to the present disclosure.
Figure 10A:
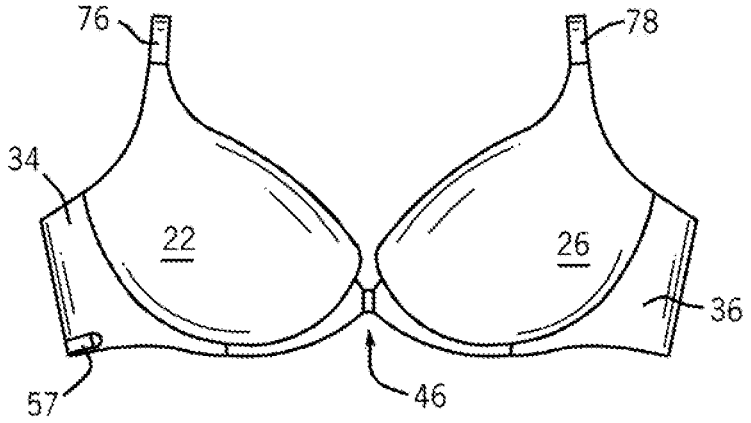
FIGS. 10A and 10B illustrate an alternative example of a front-close bra according to the present disclosure.
Figure 10B:
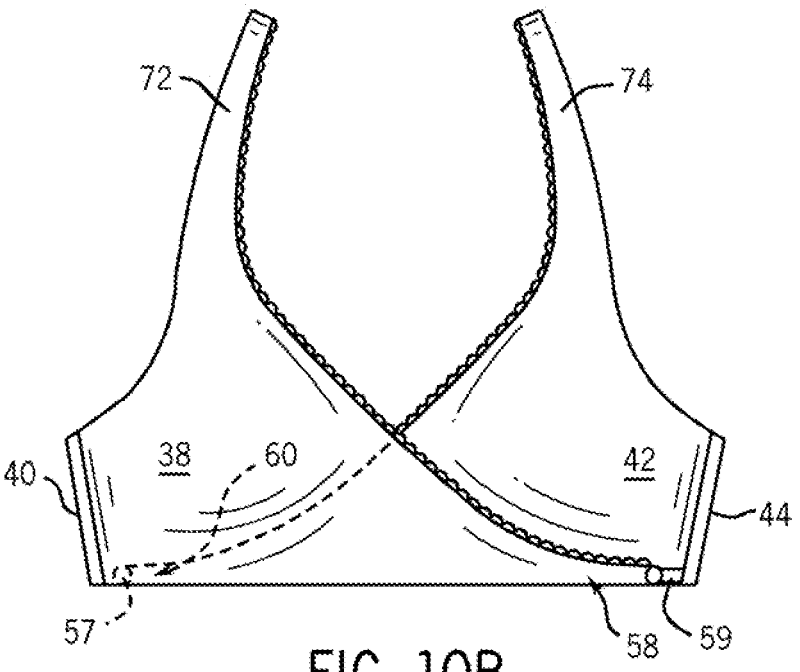

FIG. 9 illustrates another example of the front close bra 10'. The view shown is from the back of the bra 10', looking toward the front. In the view, the back panel 12 has been removed so as to show the inside of the left and right inner bra cups 22', 26'. The bra 10' has left and right outer shoulder straps 72', 74' similar to those of the bra 10 shown in FIGS. 1-8. However, the bra 10' has no inner shoulder straps. Instead, an upper portion 302 of the left inner bra cup 22' is directly connected to the outer shoulder strap 72' along a seam 304 and an upper portion 306 of the right inner bra cup 26' is directly connected to the outer shoulder strap 74' along a seam 308. Although seams 304, 306 are shown herein, such connection could alternatively be made by gluing, knitting, ultrasonic techniques, etc. Fabric pieces 310 may be provided along the top edges of the inner bra cups 22', 26' in order to secure the inner bra cups 22', 26' to the outer shoulder straps 72', 74'. Note that all other portions of the bra 10' could be similar to those shown in FIGS. 1-8, although for sake of clarity, only portions of left and right outer front panels 38', 42' have been shown in FIG. 9.

In one example, the left and right inner bra cups 22, 26 comprise a lightweight, moisture-wicking spacer fabric. The left and right inner bra cups 22, 26 may further comprise first and second pieces of foam at first and second apexes of each bra cup, respectively, so as to conceal a wearer's nipples. Concealment could alternatively be accomplished with foam padding, thermoplastic rubber, gel, fiberfill, foam, gel pads, or the like. In another example, each of the left inner bra cup 22 and the right inner bra cup 26 has a convex shape, as shown most clearly in FIG. 5. Together, the convex shape and underwires provided in the left and right inner bra cups 22, 26 allow the cups 22, 26 to encapsulate, lift, and separate a wearer's breasts. The inner bra cups 22, 26 also support each breast individually, providing maximum support. Meanwhile, the left and right outer front panels 38, 42 compress the wearer's breasts so as to minimize movement thereof. This is especially helpful while that wearer is active, such as when she is exercising.

During high impact activities a woman's breasts do not move up and down together, but rather separately, in what is called a "butterfly" or figure-eight motion. This movement of the breasts is very painful and possibly damaging to the supportive breast tissue. The combination of encapsulation of the breasts by the inner bra cups 22, 26 and compression of the breasts by the outer front panels 38, 42 counteracts this butterfly motion by providing maximum support to the bra 10 and thereby reduces impact on a wearer's breasts when the wearer is engaged in vigorous activity. Encapsulation is generally accomplished with a molded pad with or without an underwire, and comprises using two individual cups that surround each breast, keeping them separate; while compression generally involves a fabric that is itself molded or shaped slightly to control breast movement by flattening the breast tissue against the chest of the wearer. Encapsulation of the breast with a convex cup and an underwire supports, lifts, and separates the wearer's breasts instead of merely compressing them in towards the wearer's torso. Further, the inner bra cups move and flex with the wearer rather than move independently of her. In one example, the mold depth of a mold used to create the inner bra cups 22, 26 is slightly reduced, which helps control movement of the wearer's breasts during activity. The inner bra cups 22, 26 of the present disclosure, when combined with the outer front panels 38, 42, deliver maximum support while maintaining the wearer's breasts in place with comfort and without the need for excessive cover of the wearer's chest area. Compression fabric may also be used for the back panel 12, such that the entire bra 10 has a slightly firmer fit.

The outer front panels 38, 42 provide the compression required for limiting movement of the wearer's breasts during exercise, although not as much compression is needed when compared to a bra without inner bra cups. Uniting the left and right outer front panels 38, 42 together with the outer closure 56, or crossing front panels 38, 42 over one another and securing them to the remainder of the bra 10 with closures 57, 57' and 59, 59' provides the needed compression to prevent breast movement, and the location of side seams 100, 102 ensures that the fabric of the outer front panels 38, 42 is pulled tightly enough to provide such compression. Prior encapsulation of the wearer's breasts within the inner bra cups 22, 26 lessens the force required to pull the left and right outer front panels 38, 42 together in order to couple them with the outer closure 56, or across the wearer's chest in the above-mentioned cross-over configuration with closures 57, 57' and 59, 59'. This makes putting the bra 10 on very easy. Further, another benefit is that a wearer can unzip or un-cross the outer front panels 38, 42 after exercising to release the compression and breathe easier, such as during a cool-down stretch.

The bra 10 according to the present disclosure could be incorporated into many different types of clothing, including but not limited to maternity bras, everyday (i.e., non-sports) bras, camisole tops, scuba gear, or any other type of clothing. The inner bra cups 22, 26 would be connected to the outer layer of the clothing in question in much the same way as the connection shown herein to the outer front panels 38, 42. Additional or alternative connection points for the inner bra to the outer garment include, but are not limited to: along the underarms, at the straps, or at the straps and underarms.

In the above description certain terms have been used for brevity, clarity and understanding. No unnecessary limitations are to be implied therefrom beyond the requirement of the prior art because such terms are used for descriptive purposes only and are intended to be broadly construed. The different devices described herein above may be used in alone or in combination with other devices. Various equivalents, alternatives and modifications are possible within the scope of the appended claims. Each limitation in the appended claims is intended to invoke interpretation under 35 USC §112(f) only the terms "means for" or "step for" are explicitly recited in the respective limitation.

What is claimed is:

1. A front-close bra comprising:

a fabric back panel having a left side, a right side, a top side, and a bottom side;

a convexly molded left inner bra cup having a left side coupled to the left side of the back panel;

a convexly molded right inner bra cup having a right side coupled to the right side of the back panel;

a left outer front panel having a left side coupled to the left side of the back panel and configured to cover the left inner bra cup;

a right outer front panel having a right side coupled to the right side of the back panel and configured to cover the right inner bra cup;

an inner closure that couples a right side of the left inner bra cup to a left side of the right inner bra cup; and an outer closure that couples one of a right side of the left outer front panel and a left side of the right outer front panel to another area of the bra so as to hold the respective outer front panel in place over the respective inner bra cup that it covers wherein the convexly molded left and right inner bra cups are configured to encapsulate, lift, and separate a wearer's breasts; and wherein the left and right outer front panels are configured to compress the wearer's breasts so as to minimize movement thereof.

2. The front-close bra of claim 1, further comprising left and right back straps extending from the top side of the back panel.

3. The front-close bra of claim 2, further comprising left and right outer shoulder straps coupling the left and right back straps to a top portion of the left outer front panel and a top portion of the right outer front panel, respectively.

4. The front close-bra of claim 3, further comprising left and right inner shoulder straps coupling the left and right back straps to a top portion of the left inner bra cup and a top portion of the right inner bra cup, respectively.

5. The front-close bra of claim 4, wherein the left and right inner shoulder straps are coupled to first and second interior faces of the left and right outer shoulder straps, respectively.

6. The front-close bra of claim 3, wherein the left and right outer shoulder straps are coupled to the left and right back straps, respectively, by first and second rings that allow for adjustment of a length of the left and right back straps.

7. The front-close bra of claim 2, wherein the left and right back straps are coupled to the top side of the back panel proximate a center area of the back panel so as to form a racer-back shape.

8. The front-close bra of claim 1, wherein the inner closure is a clasp having a left clasp half and a mating right clasp half, the left clasp half being coupled to the right side of the left inner bra cup, and the right clasp half being coupled to the left side of the right inner bra cup.

9. The front-close bra of claim 1, wherein the outer closure couples the right side of the left outer front panel to the left side of the right outer front panel.

10. The front-close bra of claim 9, wherein the outer closure is a zipper having a left zipper half and a mating right zipper half, the left zipper half being coupled to the right side of the left outer front panel, and the right zipper half being coupled to the left side of the right outer front panel.

11. The front-close bra of claim 10, further comprising a fabric strip extending along one of the right side of the left outer front panel and the left side of the right outer front panel, the fabric strip being located behind one of the left and right zipper halves, respectively, so as to prevent contact of the zipper with a wearer's body.

12. The front-close bra of claim 10, further comprising a fabric pocket coupled to a lower portion of one of the right side of the left outer front panel and the left side of the right outer front panel, the fabric pocket enveloping a lower end of the zipper and preventing the lower end of the zipper from contacting a wearer's body.

13. The front-close bra of claim 1, wherein the left and right inner bra cups comprise first and second underwires, respectively.

14. The front-close bra of claim 1, wherein the left and right inner bra cups comprise a lightweight, moisture-wicking spacer fabric.

15. The front-close bra of claim 1, wherein the left and right inner bra cups comprise first and second pieces of foam at first and second apexes of each inner bra cup, respectively.

16. The front-close bra of claim 1, wherein the left side of the left inner bra cup and the left side of the left outer front panel are coupled to the left side of the back panel at a left side seam, and the right side of the right inner bra cup and the right side of the right outer front panel are coupled to the right side of the back panel at a right side seam.

17. The front-close bra of claim 16, further comprising a left side stay that couples the left inner bra cup to the left side of the back panel, and a right side stay that couples the right inner bra cup to the right side of the back panel.

18. A front-close bra comprising:

a fabric back panel having a left side, a right side, a top side, and a bottom side;

a left convex inner bra cup having a lower edge with a first underwire and having a left side coupled to the left side of the back panel;

a right convex inner bra cup having a lower edge with a second underwire and having a right side coupled to the right side of the back panel;

a left outer front panel having a left side coupled to the left side of the back panel and capable of covering the left inner bra cup;

a right outer front panel having a right side coupled to the right side of the back panel and capable of covering the right inner bra cup;

an inner closure that couples a right side of the left inner bra cup to a left side of the right inner bra cup;

an outer closure that couples a right side of the left outer front panel to a left side of the right outer front panel;

left and right back straps extending from the top side of the back panel;

left and right outer shoulder straps coupling the left and right back straps to a top portion of the left outer front panel and a top portion of the right outer front panel, respectively; and left and right inner shoulder straps having first ends coupled to first and second interior faces of the left and right outer shoulder straps, respectively, and second ends coupled to a top portion of the left inner bra cup and a top portion of the right inner bra cup, respectively;

wherein the left and right inner bra cups are configured to encapsulate, lift, and separate a wearer's breasts; and wherein the left and right outer front panels are configured to compress the wearer's breasts so as to minimize movement thereof.

19. The front-close bra of claim 18, wherein the inner closure is a clasp having a left clasp half and a mating right clasp half, the left clasp half being coupled to the right side of the left inner bra cup, and the right clasp half being coupled to the left side of the right inner bra cup.

20. The front-close bra of claim 18, wherein the outer closure is a zipper having a left zipper half and a mating right zipper half, the left zipper half being coupled to the right side of the left outer front panel, and the right zipper half being coupled to the left side of the right outer front panel.

21. The front-close bra of claim 1, wherein the left outer front panel and the right outer front panel both have a triangular shape;

wherein one of the left outer front panel and the right outer front panel is configured to be folded over a respective one of the left inner bra cup and the right inner bra cup; and wherein the other of the left outer front panel and the right outer front panel is configured to thereafter be folded over a respective other of the left inner bra cup and the right inner bra cup and at the same time crossed over the one of the left outer front panel and the right outer front panel so as to create a cross-over front for the front-close bra.

22. A front-close bra comprising:

a fabric back panel having a left side, a right side, a top side, and a bottom side;

a left inner bra cup having a left side coupled to the left side of the back panel;

a right inner bra cup having a right side coupled to the right side of the back panel;

a left outer front panel having a left side coupled to the left side of the back panel and configured to cover the left inner bra cup;

a right outer front panel having a right side coupled to the right side of the back panel and configured to cover the right inner bra cup;

an inner closure that couples a right side of the left inner bra cup to a left side of the right inner bra cup;

an outer closure that couples one of a right side of the left outer front panel and a left side of the right outer front panel to another area of the bra so as to hold the respective outer front panel in place over the respective inner bra cup that it covers;

left and right back straps extending from the top side of the back panel;

left and right outer shoulder straps coupling the left and right back straps to a top portion of the left outer front panel and a top portion of the right outer front panel, respectively; and left and right inner shoulder straps coupling the left and right back straps to a top portion of the left inner bra cup and a top portion of the right inner bra cup, respectively.

* * * * *